US006479431B1

(12) United States Patent
McFall et al.

(10) Patent No.: US 6,479,431 B1
(45) **Date of Patent: *Nov. 12, 2002**

(54) LAMINATION AND METHOD FOR FORMING AN INFORMATION DISPLAYING LABEL

(75) Inventors: Brian Lee McFall, St. Joseph, MI (US); Diana L. Cole, Perry, OH (US); James P. Lorence, Concord, OH (US); Thomas J. Driscoll, Mentor, OH (US)

(73) Assignee: Thelamco, Inc., Benton Harbor, MI (US)

( * ) Notice: Subject to any disclaimer, the term of this patent is extended or adjusted under 35 U.S.C. 154(b) by 155 days.

This patent is subject to a terminal disclaimer.

(21) Appl. No.: 09/676,910

(22) Filed: Oct. 2, 2000

Related U.S. Application Data

(63) Continuation-in-part of application No. 09/431,070, filed on Nov. 1, 1999, now Pat. No. 6,329,318.

(51) Int. Cl.[7] ..... B41M 5/40

(52) U.S. Cl. ..... 503/200; 156/60; 156/277; 427/152; 503/226

(58) Field of Search ..... 427/150, 152; 503/200, 201, 226; 156/60, 235, 277

(56) References Cited

U.S. PATENT DOCUMENTS

| | | | | |
|---|---|---|---|---|
| 3,388,019 | A | 6/1968 | Thigpen | 156/282 |
| 4,335,188 | A | 6/1982 | Igi et al. | 428/458 |
| 4,392,905 | A | 7/1983 | Boyd et al. | 156/235 |
| 4,505,975 | A | 3/1985 | Majima | 428/336 |
| 4,567,114 | A | 1/1986 | Oshima et al. | 428/480 |
| 4,599,259 | A | 7/1986 | Kobayashi et al. | 428/204 |
| 4,610,744 | A | 9/1986 | Smith et al. | 156/235 |
| 4,707,406 | A | 11/1987 | Inaba et al. | 428/336 |
| 4,722,868 | A | 2/1988 | Pope | 428/480 |
| 4,746,646 | A | 5/1988 | Nakanishi et al. | 503/227 |
| 4,946,372 | A | 8/1990 | Avni | 428/325 |

(List continued on next page.)

OTHER PUBLICATIONS

International Search Report for Application PCT/US00/41709.

International Preliminary Examination Report for PCT/US00/41709.

*Primary Examiner*—Bruce H. Hess
(74) *Attorney, Agent, or Firm*—Renner, Otto, Boisselle & Sklar, LLP

(57) ABSTRACT

This invention relates to a lamination comprising: a substrate having a first side and a second side; a thermally responsive coating layer overlying said first side of said substrate, said thermally responsive coating layer being capable of forming an image when heat is selectively applied to said thermally responsive coating layer; a light transmissive protective layer overlying said thermally responsive coating layer, said light transmissive protective layer having an image receiving surface and being capable of transmitting heat applied thereto to said thermally responsive coating layer; and an adhesive layer positioned between said light transmissive protective layer and said thermally responsive coating layer. In one embodiment, the lamination further comprises another light transmissive protective layer positioned between the thermally responsive coating layer and the adhesive layer. In one embodiment, the lamination further comprises an ink or graphics layer adhered to the image receiving surface of the light transmissive protective layer. In one embodiment, the lamination further comprises a friction reducing coating layer overlying the light transmissive protective layer. In one embodiment, the lamination further comprises a layer of a pressure sensitive adhesive overlying the second side of the substrate. In one embodiment, the lamination further comprises a release liner overlying the foregoing layer of pressure sensitive. The lamination has dual image receiving capability and provides protection against one or more of excessive moisture, chemicals, abrasions or ultraviolet light. A process for making the foregoing lamination is disclosed.

32 Claims, 1 Drawing Sheet

U.S. PATENT DOCUMENTS

| | | | | |
|---|---|---|---|---|
| 5,234,798 | A | 8/1993 | Heninger et al. | 430/340 |
| 5,242,739 | A | 9/1993 | Kronzer et al. | 428/200 |
| 5,262,224 | A | 11/1993 | Ozaki et al. | 428/195 |
| 5,271,990 | A | 12/1993 | Kronzer et al. | 428/195 |
| 5,294,483 | A | 3/1994 | Beavers et al. | 428/336 |
| 5,501,902 | A | 3/1996 | Kronzer | 428/323 |
| 5,543,191 | A | 8/1996 | Dronzek, Jr. et al. | 428/41.5 |
| 5,576,092 | A | 11/1996 | Jongewaard et al. | 428/195 |
| 5,773,386 | A | 6/1998 | Langan | 503/226 |
| 5,798,179 | A | 8/1998 | Kronzer | 428/411.1 |
| 6,329,318 | B1 * | 12/2001 | McFall | 503/201 |

* cited by examiner

LAMINATION AND METHOD FOR FORMING AN INFORMATION DISPLAYING LABEL

This application is a continuation-in-part of U.S. application Ser. No. 09/431,070 filed Nov. 1, 1999, now U.S. Pat. No. 6,329,318. The disclosure in said prior application is incorporated herein by reference in its entirety.

FIELD OF THE INVENTION

The present invention relates to laminations which are useful as information displaying labels. These laminations have dual image receiving capability. The invention also relates to a method for making such laminations.

BACKGROUND OF THE INVENTION

There is a need in the labeling industry for a lamination which is useful as a label having dual image receiving capability. It would be advantageous if such a lamination contained a protected thermally responsive information receiving surface.

This invention addresses this need by providing a lamination which is capable of displaying one image on a light transmissive protective layer that overlies a second image formed on an underlying thermally responsive coating layer. The light transmissive protective layer is capable of permitting image printing on its surface and it is sufficiently heat transmissive to permit the passage of heat to the underlying thermally responsive coating layer to permit the formation of a heat activated image in the underlying thermally responsive coating layer. The light transmissive protective layer is transmissive to light so that, in one embodiment, both images may be viewed simultaneously. The invention further provides a lamination wherein the formed images, in one embodiment, are protected from one or more of excessive moisture, chemicals, abrasions and ultraviolet light.

SUMMARY OF THE INVENTION

In one embodiment, the invention relates to a lamination for use in an information displaying label, including: (a) a substrate; (b) a thermally responsive coating on at least one surface of said substrate, said coating being thermally responsive to form an image when heat is selectively applied at a first temperature to said lamination; (c) a light transmissive protective layer overlying said thermally responsive coating, said protective layer having an image receiving surface thereon and being capable of transmitting heat applied thereto at said first temperature (e.g., about 50° C. to about 95° C.) to said thermally responsive coating to form a heat activated image thereon; and (d) an adhesive layer for bonding said protective layer to said coating, said adhesive layer providing a stable bond and being non-reactive with said coating, said adhesive layer being activated at a second temperature (e.g., about 15° C. to about 50° C.) which is lower than said first temperature.

In one embodiment, the invention relates to a lamination, comprising: a substrate having a first side and a second side; a thermally responsive coating layer overlying said first side of said substrate, said thermally responsive coating layer being capable of forming an image when heat is selectively applied to said thermally responsive coating layer; a light transmissive protective layer overlying said thermally responsive coating layer, said light transmissive protective layer having an image receiving surface and being capable of transmitting heat applied thereto to said thermally responsive coating layer; and an adhesive layer positioned between said light transmissive protective layer and said thermally responsive coating layer.

In one embodiment, the invention relates to a lamination, comprising: a substrate having a first side and a second side; a thermally responsive coating layer overlying said first side of said substrate, said thermally responsive coating layer being capable of forming an image when heat is selectively applied to said thermally responsive coating layer; a light transmissive protective layer overlying said thermally responsive coating layer, said light transmissive protective layer having an image receiving surface and being capable of transmitting heat applied thereto to said thermally responsive coating layer; an adhesive layer positioned between said light transmissive protective layer and said thermally responsive coating layer; a layer of a pressure sensitive adhesive overlying said second side of said substrate; and a release liner adhered to said layer of said pressure sensitive adhesive.

In one embodiment the invention relates to a process for forming a label laminate including the steps of: (a) coating a substrate with a thermally responsive coating, which coating is thermally responsive to the selective application of heat at a first temperature (e.g., about 50° C. to about 95° C.) to form information images thereon; (b) applying a dry adhesive in a predetermined amount on said thermally responsive coating, said adhesive being non-reactive with said coating; (c) applying a light transmissive protective layer on said adhesive, said layer being heat transmissive and having an image receiving surface thereon; (d) applying heat to said laminate at a second temperature (e.g., about 15° C. to about 50° C.) lower than said first temperature to form a bond between said layer and coating.

In one embodiment, the invention relates to a process for forming a lamination, comprising: forming a first composite construction by coating one side of a substrate with a thermally responsive coating layer, and then coating the thermally responsive coating layer with a light transmissive protective coating layer; forming a second composite construction by applying a release coating layer to a backing liner, curing the release coating, and then coating the cured release coating with a layer of a pressure sensitive adhesive; forming a third composite construction by coating one side of a light transmissive protective film with a friction reducing coating layer, said light transmissive protective film having an image receiving surface, and coating the other side of the light transmissive protective film with an adhesive layer; forming a first intermediate construction by adhering the first composite construction to the second composite construction; and forming said lamination by adhering said first intermediate construction to said third composite construction. In one embodiment, an ink or graphics layer is adhered to the image receiving surface of the light transmissive protective film prior to coating the light transmissive protective film with the adhesive layer, and then the ink or graphics layer is coated with the adhesive layer.

BRIEF DESCRIPTION OF THE DRAWINGS

In the amended drawings, like parts and features have like designations.

DETAILED DESCRIPTION OF THE PREFERRED EMBODIMENT

Figure 1:
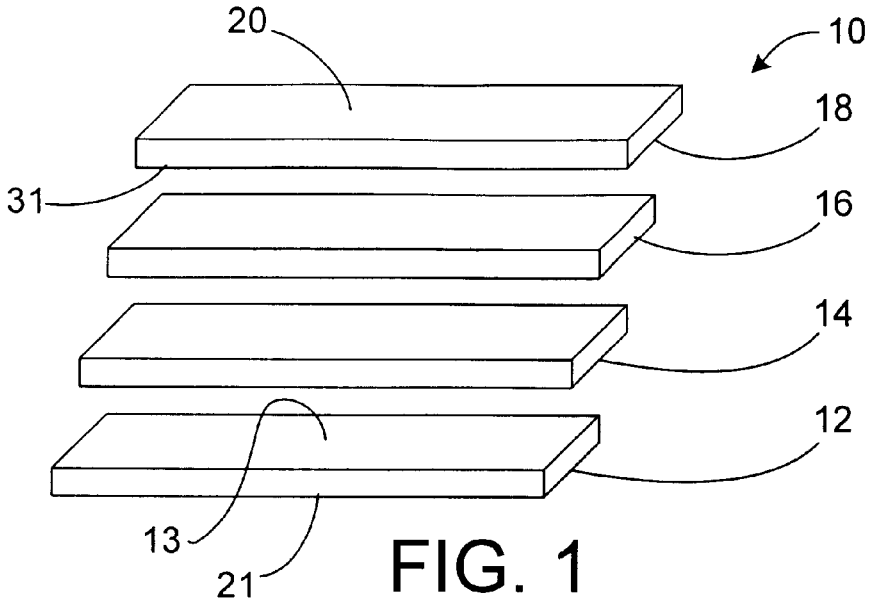
FIG. 1 is an exploded perspective view of a lamination embodying the present invention in a particular form.
Figure 2:
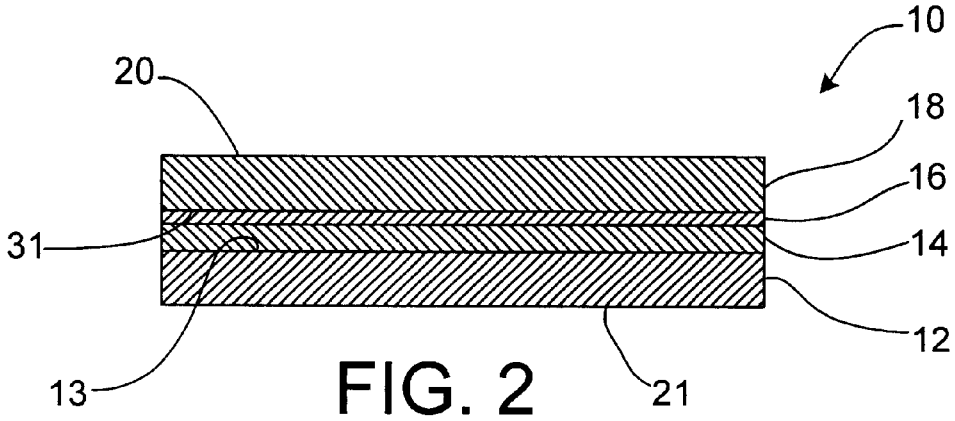
FIG. 2 is a schematic illustration of a cross-sectioned side view of the lamination illustrated in FIG. 1.

Referring to the drawings, laminations 10 (FIGS. 1 and 2) and 10A (FIG. 3) include a substrate 12 which has a first side 13 and a second side 21. A thermally responsive coating layer 14 overlies side 13 of substrate 12. Adhesive layer 16 overlies thermally responsive coating layer 14. Light transmissive protective layer 18 overlies adhesive layer 16. In the embodiment illustrated in FIGS. 1 and 2, the adhesive layer 16 bonds the light transmissive protective layer 18 to the thermally responsive coating layer 14.

Figure 3:
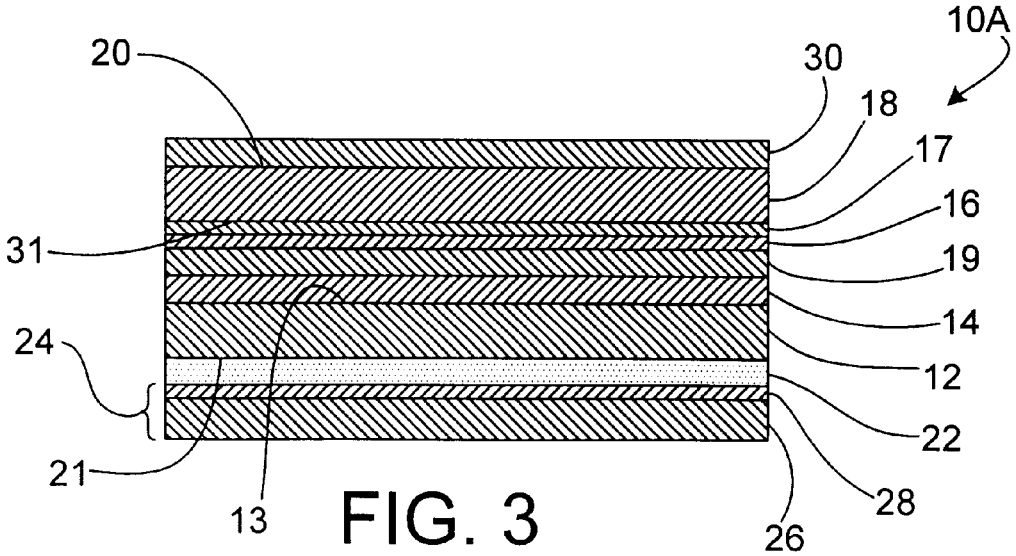
FIG. 3 is a schematic illustration of a cross-sectioned side view of a lamination embodying the present invention in another form.

Referring to FIG. 3, an ink or graphics layer 17 overlies and is adhered to the underside 31 of light transmissive protective layer 18. (In an alternate embodiment (not shown in the drawings), the ink or graphics layer is adhered to side 20 of light transmissive protective layer 18, and another light transmissive protective layer is applied to the ink or graphics layer.) Light transmissive protective layer 19 overlies and is adhered to thermally responsive coating layer 14. Adhesive layer 16 is positioned between ink or graphics layer 17 and the another light transmissive protective layer 19. A layer 22 of a pressure sensitive adhesive overlies and is adhered to the second side 21 of substrate 12, and a release liner 24 overlies and is adhered to the pressure sensitive adhesive layer 22. The release liner 24 is comprised of a backing liner 26 and a first release coating layer 28. The release coating 28 is positioned between the pressure sensitive adhesive layer 22 and backing liner 26, and is preferentially adherent to the backing liner 26. The pressure sensitive adhesive layer 22 is positioned between the release coating 28 and the substrate 12, and is preferentially adherent to the substrate 12. A friction reducing coating layer 30 overlies and is adhered to side 20 of light transmissive protective layer 18.

The substrate 12 may be comprised of paper, film, board or a non-woven material. The substrate 12 may be comprised of a metal foil, polymer film, paper or combinations thereof. The substrate may be comprised of textile including woven and non-woven fabrics made of natural or synthetic fibers. The substrate 12 may be comprised of single-layered sheets or films or multi-layered constructions. These include polymeric films and multi-layered polymeric films. The multi-layered constructions and multilayered polymeric films may have two or more layers, and in one embodiment about two to about seven layers, and in one embodiment about three to about five layers. The layers of such multi-layered constructions and films may have the same composition and/or size or they may be different.

The metal foils include foils of such metals as copper, gold, silver, tin, chromium, zinc, nickel, platinum, palladium, iron, aluminum, steel, lead, brass, bronze, and alloys of the foregoing metals. Examples of such alloys include copper/zinc, copper/silver, copper/tin/zinc, copper/phosphorus, chromium/molybdenum, nickel/chromium, nickel/phosphorous, and the like. The metal foils can be used by themselves or they can be joined or adhered to a polymeric sheet or film to form a multi-layered laminate or construction.

The polymer films include polyolefins (linear or branched), polyamides, polystyrenes, nylon, polyesters, polyester copolymers, polyurethanes, polysulfones, styrene-maleic anhydride copolymers, styrene-acrylonitrile copolymers, ionomers based on sodium or zinc salts of ethylene methacrylic acid, polymethyl methacrylates, cellulosics, acrylic polymers and copolymers, polycarbonates, polyacrylonitriles, and ethylene-vinyl acetate copolymers. Included in this group are the acrylates such as ethylene methacrylic acid, ethylene methyl acrylate, ethylene acrylic acid and ethylene ethyl acrylate. Also, included in this group are polymers and copolymers of olefin monomers having, for example, 2 to about 12 carbon atoms, and in one embodiment 2 to about 8 carbon atoms. These include the polymers of $\alpha$-olefins having from 2 to about 4 carbon atoms per molecule. These include polyethylene, polypropylene, poly-1-butene, etc. An example of a copolymer within the above definition is a copolymer of ethylene with 1-butene having from about 1 to about 10 weight percent of the 1-butene comonomer incorporated into the copolymer molecule. The polyethylenes that are useful have various densities including low, medium and high density ranges. The low density range is from about 0.910 to about 0.925 g/cm$^3$; the medium density range is from about 0.925 to about 0.940 g/cm$^3$; and the high density range is from about 0.940 to about 0.965 g/cm$^3$. An example of a commercially available material that is useful is available from Du Pont under the trade designation Mylar LB; this material is identified as being a biaxially oriented polyester film. Films prepared from blends of copolymers or blends of copolymers with homopolymers also are useful. The films may be extruded as monolayered films or multi-layered films. The films may be oriented films or nonoriented films.

The paper sheets include paper, clay coated paper, glassine, paperboard from straw, bark, wood, cotton, flax, cornstalks, sugarcane, bagasse, bamboo, hemp, and similar cellulose materials prepared by such processes as the soda, sulfite or sulfate (Kraft) processes, the neutral sulfide cooking process, alkalichlorine processes, nitric acid processes, semi-chemical processes, etc. Although paper of any basis weight can be employed, paper having basis weights in the range of from about 20 to about 150 pounds per ream (lb/ream) are useful, and papers having weights in the range of from about 30 to about 60 lb/ream can be used. The term "ream" is used herein to mean 3300 square feet.

The substrate 12 may be comprised of a polymer-coated paper which is comprised of a sheet of paper that is coated on either one or both sides with a polymer coating. The polymer coating, which may be comprised of a high, medium, or low density polyethylene, polypropylene, polyester, and other similar polymer films, is coated on the paper surface to add strength and/or dimensional stability. The weight of these types of coated paper facestocks can vary over a wide range with weights in the range of about 5 to about 50 lb/ream being useful. In total, the final coated paper facestock may be comprised of between about 10% and about 40% by weight polymer. For two-sided coatings, the quantity of polymer is usually approximately evenly divided between the top and bottom surface of the paper.

The substrate 12 may have a thickness in the range of about 0.3 to about 20 mils, and in one embodiment about 0.3 to about 10 mils, and in one embodiment about 0.5 to about 5 mils, and in one embodiment about 0.5 to about 4 mils, and in one embodiment about 0.5 to about 3.5 mils, and in one embodiment about 0.5 to about 3 mils.

The thermally responsive coating layer 14, which may be referred to as a thermal developing layer, may be comprised of any coating material capable of forming an image in response to the selective application of heat. These coating materials may be derived from ferric ionic inorganic salt solutions. They may be comprised of leuco-type dyes, and the like.

The leuco-type dyes are typically used in combination with a color developing agent. Representative examples of the leuco-type dyes include crystal violet lactone, 3-diethylamino-7-chlorofluoran, 3-diethylamino-6-methyl-7-chlorofluoran, 3-cyclohexylamino-6-chlorofluoran, 3-diethylamino-7-dibenzylaminofluoran, 3-pyrrolidino-6-methyl-7-anilinofluoran, 3-piperidino-6-methyl-7-anilinofluoran, 3-cyclohexylmethylamino-6-methyl-7-anilinofluoran, 3-ethylisoamylamino-6-methyl-7-anilinofluoran, 3-diethylamino-7-(o-chloroanilino) fluoran and 3-dibutylamino-7-(o-chloroanilino)fluoran. Representative examples of the color developing agents include alpha-naphthol, beta-naphthol, 4-t-butylphenol, 4-t-butylphenol, 4-t-octylphenol, 4-phenylphenol, 2,2-bis(p-hydroxyphenyl) propane, 2,2-bis(hydroxyphenyl)butane, 4,4'-cyclohexylidine diphenol, 2,2-bis(2,5-dibromo-4-hydroxyphenyl)propane, 4,4'-isopropylidine bis(2-t-butylphenol), 2,2'-methylene bis(4-chlorophenol), 4,4'-sulfonyldiphenol, 4,4'-thiobisphenol, as well as derivatives of benzoic acid, salicylic acid and gallic acid.

The thermally responsive coating layer 14 may include low melting point materials such as stearic amide and other amides of higher fatty acids, naturally occurring waxes such as beeswax, shellac wax and carnauba wax, mineral waxes such as montan wax, paraffin wax, microcrystalline wax, higher fatty acids, esters of higher fatty acids, esters of aromatic carboxylic acids such as dimethylterephthalate and diphenylphthalate, derivatives of alkyl naphthalene compounds, derivatives of alkyl diphenyl compounds, derivatives of alkyl terphenyl compounds, and the like.

The thermally responsive coating layer 14 may include organic or inorganic pigments to improve resolution of developed images in the thermally responsive coating layer. Examples include light calcium carbonate, heavy calcium carbonate, aluminum hydroxide, titanium oxide, zinc oxide, barium sulfate, talc, clay, satin white, kaolinite, polyolefin particles, polystyrene particles, urea-formalin resin particles, and the like.

The thermally responsive coating layer 14 may include surfactants, antifoaming agents, anti-oxidants, ultraviolet light absorbing agents, and the like. The thermally responsive coating layer 14 may include a binder agent. Examples of such binder agents include casein, gelatin, polyvinyl alcohol, polyvinyl pyrrolidone, starch, converted starch, isobutylene-maleic anhydride resin, diisobutylene-maleic anhydride resin, styrene-maleic anhydride resin, polyacrylamide, carboxymethylcellulose, methylcellulose, hydroxyethylcellulose, polyvinyl acetate, acrylic ester polymer, vinyl chloride-vinyl acetate copolymer, emulsions such as SBR (styrene-butadiene rubber) and NBR (nitrilebutadiene rubber), latex, as well as mixtures of any of the preceding.

Examples of thermally responsive coating compositions that may be used to form the coating layer 14 include those available under the trade designations T1057 and T2062 from the Appleton Paper Company. These coatings are described by Appleton Paper as being thermally sensitive organic coating compositions.

The thermally responsive coating layer 14 is capable of responding to the selective application of heat at a predetermined temperature to form a desired image. The image formed in this layer may be a variable information image, e.g., bar code, serial number, etc. The predetermined temperature may be in the range of about 50° C. to about 95° C., and in one embodiment about 65° C. to about 85° C.

The thermally responsive coating layer 14 may have a thickness of about 0.1 to about 1.2 mils, and in one embodiment about 0.1 to about 0.6 mil, and in one embodiment about 0.2 to about 0.3 mil.

The light transmissive protective coating layer 19, which is applied over thermally responsive coating layer 14, may be made from any transparent solvent-based, water-based or radiation-curable coating material designed to provide resistance to moisture, one or more common chemicals (see the list of common chemicals below in the discussion concerning the light transmissive protective layer 18) and/or abrasions. This coating layer may be made from UV curable oligomers selected from one or more epoxies, urethanes, polyesters, acrylics, or a combination of two or more thereof, and the like. These may be cured by free-radicals generated by photoinitiators after exposure to UV light. Reactive diluents such as hexanediol diacrylate, pentaerythritol, tetraacrylate, N-vinylpyrrolidinone, and the like, can be used to control viscosity of the coating before cure and to modify the crosslink density. Epoxy resins and alkyl vinyl ethers, which are cationically cured, may be used. Reactive diluents such as vinyl ethers, limonene dioxide, glycidyl ether, and the like, may be used. The coating may also contain wetting agents, leveling agents, waxes, slip aids, and light stabilizers. This coating layer typically has a thickness of up to about 0.5 mil, and in one embodiment about 0.1 to about 0.5 mil, and in one embodiment about 0.1 to about 0.2 mil.

The adhesive layer 16 may be comprised of a moisture-curable adhesive, catalyst-curable adhesive or a pressure sensitive adhesive. The adhesive may be clear or transparent, or it may be colored. The moisture-curable adhesive may be any adhesive that cures in the presence of moisture. An example of a useful moisture-curable adhesive is available from Morton Adhesives under the tradename Adcote 331. This material is identified as a single component, isocyanate terminated, polyether urethane adhesive. The moisture used to cure these adhesives may be extracted from the ambient atmosphere as the adhesive cures. This adhesive may be applied at a dry film coat weight of about 0.5 to about 3 pounds per 3000 $ft^2$, and in one embodiment about 0.8 to about 1.5 pounds per 3000 $ft^2$.

The catalyst-curable adhesive may be any adhesive suitable for application to a paper or film substrate that cures in the presence of a catalyst. An example of a useful adhesive is Avadyne AV5100 which is a product of Pierce & Stevens identified as a catalyzed polyester adhesive. These catalyst-curable adhesives may be applied at a dry film thickness of about 0.5 to about 3 pounds per 3000 $ft^2$, and in one embodiment about 1.5 to about 2.5 pounds per 3000 $ft^2$.

The pressure-sensitive adhesive may be any pressure sensitive adhesive known in the art. These include rubber based adhesives, acrylic adhesives, vinyl ether adhesives, silicone adhesives, and mixtures of two or more thereof. Included are the pressure sensitive adhesive materials described in "Adhesion and Bonding", *Encyclopedia of Polymer Science and Engineering,* Vol. 1, pages 476–546, Interscience Publishers, 2nd Ed. 1985, the disclosure of which is hereby incorporated by reference. The pressure sensitive adhesive materials that are useful may contain as a major constituent an adhesive polymer such as acrylic type polymers, block copolymers, natural, reclaimed or styrene butadiene rubbers, tackified natural or synthetic rubbers, random copolymers of ethylene and vinyl acetate, ethylene-vinyl-acrylic terpolymers, polyisobutylene, poly(vinyl ether), etc. The pressure sensitive adhesive materials are typically characterized by glass transition temperatures in the range of about −70° C. to about 10° C. Other materials in addition to the foregoing resins may be included in the pressure sensitive adhesive materials. These include solid tackifying resins, liquid tackifiers (often referred to as plasticizers), antioxidants, fillers, pigments, waxes, ultraviolet light inhibitors, etc. The adhesive materials may contain a blend of solid tackifying resins and liquid tackifying resins (or liquid plasticizers). The pressure sensitive adhesive may be applied at a coat weight of about 10 to about 60 grams per square meter (gsm), and in one embodiment about 14 to about 20 gsm.

The adhesive layer 16, in one embodiment, is a dry bonding type adhesive which has clear and non-yellowing properties. These include those available under the trade designations Adcote 331 and Avadyne AV5100 which are mentioned above. Specific uses of the inventive laminations may require that ultraviolet inhibitors be added to the adhesive layer 16 to protect the adhesive layer from sunlight exposure. An ultraviolet inhibiting adhesive that may be used is a blend of "EPS72-EA70" and catalyst CA720 at 100:14 ratio; which is available from Pierce & Stevens. In one embodiment, the adhesive layer 16 is applied at a dry coat weight from about 1.3 pounds to about 2.5 pounds per 3000 square feet.

The adhesive layer 16 may be applied in liquid form to the underside 31 of light transmissive protective layer 18 (or alternatively to the ink or graphics layer 17 adhered to underside 31) using any conventional technique known in the coating art including roller coating, curtain coating, brushing, spraying, reverse roll coating, doctor knife, dipping, die coating, offset gravure techniques, etc. The liquid being applied may be heated or cooled to facilitate the coating process and to alter the depth of penetration of the liquid into the surface being coated. In one embodiment, the liquid is then dried at a temperature of about 15° C. to about 95° C., and in one embodiment about 15° C. to about 65° C.

The light transmissive protective layer 18 is a film layer which may be derived from any light transmissive thermoplastic polymer composition having a melting point in the range of about 85° C. to about 600° C., and in one embodiment about 200° C. to about 450° C., and in one embodiment about 245° C. to about 265° C., and a thermal conductivity in the range of about $1\times10^{-4}$ to about $10\times10^{-4}$ calories/cm-sec-° C., and in one embodiment about $3\times10^{-4}$ to about $4\times10^{-4}$ calories/cm-sec-° C. The term "light transmissive" is used herein to refer to the fact that images formed in the underlying thermally responsive coating layer 14 may be viewed through the layer 18. In one embodiment, the light transmissive protective layer 18 is sufficiently resistant to moisture, common chemicals and/or abrasions to protect the laminations 10 or 10A from anticipated environmental exposures as well as damage from use or handling. The common chemicals which the layer 18 may guard against include one or more of xylene, toluene, methyl ethyl ketone, acids such as hydrochloric acid, alcohols such as isopropyl alcohol, acetone, acetates, oil-based materials such as grease, fatty acids, water, and the like. The polymers that may be used to form the light transmissive protective layer 18 include esters, urethanes, epoxies, phenoxies, acrylics, combinations of two or more thereof, and the like. The polymer may be a polyolefin (e.g., polyethylene, polypropropylene), polyvinyl chloride, polystyrene, and the like. Copolymers of any of the foregoing may be used. The polymer may be radiation-curable or heat-curable. The polymer composition may contain wetting agents, surfactants, waxes, slip aids, light stabilizers, ultraviolet light absorbers, thermal conductivity additives, and the like.

The surface 20 or the surface 31, or both surfaces 20 and 31, of light transmissive and protective layer 18 may be image receiving surfaces adapted to facilitate label printing on the protective layer 18. The surfaces 20 and/or 31 that are adapted for receiving a printed image, in one embodiment, have a surface energy of about 30 to about 70 dynes, and in one embodiment about 38 to about 50 dynes, and in one embodiment about 38 to about 44 dynes.

The light transmissive protective layer 18 may have a 48 gauge thickness, but other thicknesses may be used. The light transmissive protective layer 18 may have a gauge thickness of about 5 to about 200, and in one embodiment about 14 to about 34, and in one embodiment about 14 to about 26, and in one embodiment about 18 to about 22.

The ink or graphics layer 17, which is an optional layer, may be a mono-colored or multi-colored ink layer, depending on the printed message and/or pictorial design intended for the lamination. These include non-variable imprinted messages or designs such as logos, graphics, background color, and the like. The thickness of the ink or graphics layer 17 is typically in the range of about 0.5 to about 5 microns, and in one embodiment about 1 to about 4 microns, and in one embodiment about 3 microns. The inks used in the ink or graphics layer 17 may be commercially available water-based, solvent-based or radiation-curable, (e.g., UV curable) inks appropriately chosen for the particular construction of the lamination and/or the particular printing method used. Examples include CLVCW series inks from Akzo Nobel and WFLO series inks from Environmental Inks. Other examples include Hydrofilm 4000 which is available from Akzo Nobel, and the inks available from Sun Chemical under the trade designations Aquasurf, Hydrofast and Hydropoly.

In one embodiment (not shown in the drawings), an image may be formed on the surface 20 of light transmissive protective layer 18 using one or more of the foregoing inks. In this embodiment, it is beneficial to apply a light transmissive protective coating layer, similar to coating layer 19, over the image formed on surface 20 to protect the image from environmental exposure as well as damage from handling or use.

The release coating 28 may be any release coating known in the art. Silicone release coatings are useful, and any of the silicone release coating compositions which are known in the art can be used. The major component of the silicone release coating is a polyorganosiloxane and more often polydimethylsiloxane. The silicone release coating compositions used in this invention may be room temperature cured, thermally cured, or radiation cured. Generally, the room temperature and thermally curable compositions comprise at least one polyorganosiloxane and at least one catalyst (or curing agent) for such polyorganosiloxane(s). Such compositions may also contain at least one cure accelerator and/or adhesivity promoter. As is known in the art, some materials have the capability of performing both functions, i.e., the capability of acting as a cure accelerator to increase the rate, reduce the curing temperature, etc., and also as an adhesivity promoter to improve bonding of the silicone composition to the substrate. The use of such dual function additives where appropriate is within the purview of the invention.

The release coating 28 is applied to the backing liner 26 using known techniques. These include gravure, reverse gravure, offset gravure, roller coating, brushing, knife-over roll, metering rod, reverse roll coating, doctor knife, dipping, die coating, spraying curtain coating, and the like. The coat weight may be in the range of about 0.1 to about 10 grams per square meter (gsm) or more, and in one embodiment about 0.3 to about 2 gsm. In one embodiment, the thickness or caliper of the resulting release liner may range from about 4 to about 10 mils, and in one embodiment from about 4 to about 6 mils.

The backing liner 26 may comprise paper, polymer film, or a combination thereof. Paper liners are useful because of the wide variety of applications in which they can be employed. Paper is also relatively inexpensive and has desirable properties such as antiblocking, antistatic, dimensional stability, and can potentially be recycled. Any type of paper having sufficient tensile strength to be handled in conventional paper coating and treating apparatus can be employed as the substrate material. Thus, any type of paper can be used depending upon the end use and particular personal preferences. Included among the types of paper which can be used are clay coated paper, glassine, polymer coated paper, hemp, and similar cellulose materials prepared by such processes as the soda, sulfite or sulfate (Kraft) processes, the neutral sulfide cooking process, alkali-chlorine processes, nitric acid processes, semi-chemical processes, etc. Although paper of any weight can be employed as a substrate material, paper having weights in the range of from about 30 to about 120 pounds per ream are useful, and papers having weights in the range of from about 60 to about 100 pounds per ream are presently preferred. The term "ream" as used herein equals 3000 square feet.

Alternatively, the backing liner 26 may be a polymer film, and examples of polymer films include polyolefin, polyester, and combinations thereof. The polyolefin films may comprise polymer and copolymers of monoolefins having from 2 to about 12 carbon atoms, and in one embodiment from 2 to about 8 carbon atoms, and in one embodiment 2 to about 4 carbon atoms per molecule. Examples of such homopolymers include polyethylene, polypropylene, poly-1-butene, etc. The examples of copolymers within the above definition include copolymers of ethylene with from about 1% to about 10% by weight of propylene, copolymers of propylene with about 1% to about 10% by weight of ethylene or 1-butene, etc. Films prepared from blends of copolymers or blends of copolymers with homopolymers also are useful. The films may be extruded in mono or multilayers.

Another type of material which can be used as the backing liner 26 is a polycoated kraft liner which is basically comprised of a kraft liner that is coated on either one or both sides with a polymer coating. The polymer coating, which can be comprised of high, medium, or low density polyethylene, propylene, polyester, and other similar polymer films, is coated onto the substrate surface to add strength and/or dimensional stability to the liner. The weight of these types of liners ranges from about 30 to about 100 pounds per ream, with about 94 to about 100 pounds per ream representing a typical range. In total, the final liner is comprised of between 10% and 40% polymer and from 60% to 90% paper. For two sided coatings, the quantity of polymer is approximately evenly divided between the top and bottom surface of the paper.

The backing liner may have a thickness of about 0.5 to about 12 mils, and in one embodiment about 1 to about 8 mils, and in one embodiment about 2 to about 4 mils.

The adhesive layer 28 may be comprised of any of the pressure sensitive adhesives discussed above. The adhesive layer 22 may have a thickness of about 0.2 to about 2.5 mils, and in one embodiment about 0.5 to about 1.5 mils. In one embodiment, the coat weight of the pressure sensitive adhesive is in the range of about 10 to about 50 grams per square meter (gsm), and in one embodiment about 20 to about 35 gsm.

The friction reducing coating layer 30, which may be referred to as a jaw release, may be derived from any of the release coating compositions described above as being useful for the release coating 28. The friction reducing coating layer 30 may also be comprised of one or more waxes, acrylates or high temperature polyethylenes. The friction reducing coating layer 30 may be comprised of teflon. A commercially available material that can be used is available under the trade designation clear Amertech C-41 324-WI, which is a product of American Inks and Coatings. The friction reducing coating layer 30 may have a coat weight of about 0.1 to about 2.5 gsm, and in one embodiment about 0.8 to about 2 gsm, and in one embodiment about 1 to about 1.7 gsm. The layer 30 may be applied to the side 20 of the light transmissive protective layer 18 using any of the techniques described above for applying release coating 28 to backing liner 26. The friction reducing coating layer 30 is provided to facilitate movement of the print head of the thermal printer as it moves over or slides against the surface 20 of the lamination 10 or 10A during the application of the heat required for forming the image in the thermally responsive coating layer 14.

The method for forming lamination 10 or 10A, in one embodiment, includes the steps of coating the substrate 12 with the thermally responsive coating 14, applying the adhesive layer 16 to the thermally responsive coating layer 14, applying the light transmissive protective film layer 18 to the adhesive layer 16, and heating the adhesive layer 16 to bond the coating layer 14 to the light transmissive protective film layer 18. The adhesive layer 16 may be heated to a temperature in the range of about 15° C. to about 50° C., and in one embodiment about 30° C. to about 35° C. This bonding temperature should be lower than the temperature required to activate the thermally responsive coating layer 14.

The lamination 10A may be assembled in a series of steps. In the first step a composite construction corresponding to layers 12, 14 and 19 is formed. The substrate 12 is coated on side 13 with the thermally responsive coating layer 14. The light transmissive protective layer 19 is then coated on the thermally responsive coating layer 18.

A second composite construction is prepared by applying release coating layer 28 to backing liner 26, curing the release coating and then coating the resulting release layer with pressure sensitive adhesive layer 22.

A third composite construction is prepared by coating one side of light transmissive protective film 18 with friction reducing coating 30. The other side of the light transmissive protective film 18 is coated with adhesive layer 16. In one embodiment, ink or graphics layer 17 is applied to side 31 of light transmissive protective layer 18, and then the adhesive layer 16 is applied to the ink or graphics layer 17. In one embodiment (not shown in the drawings), the ink or graphics layer is applied to side 20 of the light transmissive protective layer 18 and then another light transmissive protective coating is applied over the ink or graphics layer; the friction reducing coating 30 is then applied over the light transmissive protective coating.

A lamination corresponding to the lamination 10A is made by forming a first intermediate construction by adhering the first composite construction to the second composite construction by contacting the side 21 of substrate 12 and adhesive layer 22. The first intermediate construction is then adhered to the third composite construction by contacting adhesive layer 16 and light transmissive layer 19 to form lamination 10A.

The equipment and procedures for selectively applying heat to the lamination 10 or 10A to form the desired heat-activated image in the coating layer 14 are known. Examples of the equipment that can be used include dot matrix thermal printers such as Zebra 140XI2 supplied by Zebra Technology, Datamax Prodigy Plus supplied by Datamax, Hobart 500 TE supplied by Hobart, Intermec 4440 supplied by Intermec, and Datasouth Freeliner supplied by Datasouth. The image may be formed by placing the print head of the printer in contact with the release coating layer 30 and transmitting heat in the desired pattern to the thermally responsive coating layer 14 to form the desired image.

EXAMPLE 1

Step A

A first composite construction corresponding to layers 12, 14 and 19 in FIG. 3 is prepared by coating a 52 pound/ream paper having a thickness of 2.8 mils with a layer of a thermally active leuco-type dye and then coating the dye layer with a clear environmental top coat. The 52 pound/ream paper corresponds to the substrate 12. The layer of thermally active leuco-type dye corresponds to the thermally responsive coating layer 14. The clear environmental top coat corresponds to the light transmissive protective layer 19. This laminate construction is available commercially from Avery Dennison under the trade designation 300HD.

Step B

A second composite construction is prepared by coating a 40 pound/ream super calendered kraft (SCK) paper with a layer of a silicone release agent and then after curing the release coating agent the resulting release layer with 20 grams per square meter of a layer of AT-20 (a product of Avery Dennison identified as an acrylic emulsion pressure sensitive adhesive). The SCK paper corresponds to the backing liner 26 in FIG. 3. The release layer corresponds to the release coating layer 28. The AT-20 adhesive layer corresponds to adhesive layer 22.

Step C

A third composite construction is prepared by coating one side of an 18 gauge clear polyester film supplied by Toray TPA under the tradename Lumirror F53 with a layer of clear Amertech C41324-WI (a product of American Inks and Coating Corporation identified as a water ink) at a dry film weight of 0.8 pound per 3000 $ft^2$. The other side of the polyester film is coated with a layer of Avadyne AV5100 (a product of Pierce & Stevens identified as a catalyzed polyester adhesive polymer) at a dry coat weight of 1.5 pounds per 3000 $ft^2$. The polyester film corresponds to the light transmissive protective layer 18 in FIG. 3. The layer of clear Amertech C41324-WI corresponds to the friction reducing coating layer 30. The layer of Avadyne AV5100 corresponds to the adhesive layer 16.

Step D

A lamination corresponding to the lamination 10A in FIG. 3 is made by forming a first intermediate construction by adhering the first composite construction formed in Step A to the second composite construction formed in Step B by contacting the paper substrate of the first composite construction and the layer of pressure sensitive adhesive from the second composite construction. The side of the paper substrate contacted with the pressure sensitive adhesive is the side opposite the side coated with the thermally active leuco-type dye. This side corresponds to the first side 13 of the substrate 12 in FIG. 3. The first intermediate construction is then adhered to the third composite construction from Step C by contacting the layer of Avadyne AV5100 (corresponding to adhesive layer 16) in the third composite construction and the clear environmental top coat layer (corresponding to the light transmissive layer 19) in the first intermediate construction to form a lamination corresponding to lamination 10A in FIG. 3.

EXAMPLE 2

The lamination formed in Example 1 is repeated with the exception that during Step C an ink or graphics layer using a WFLO series ink from Environmental Inks is printed on the side of the polyester film opposite the side coated with the Clear Amertech C-41324-WI prior to coating such side with the Avadyne AV 5100 adhesive. The Avadyne AV 5100 adhesive is then coated over the WFLO series ink layer. The ink layer is applied at a thickness of 3 microns. The WFLO series ink layer corresponds to the ink on graphics layer 17 in FIG. 3. The side of the polyester film coated with the ink layer corresponds to underside 31 in FIG. 3.

EXAMPLE 3

A bar code is formed in the thermally active leuco-type dye layer of the lamination made in Example 1 using a Datamax Prodigy Plus dot matrix thermal printer with the print head in contact with the layer of clear Amertech C-41324-WI and heat being transmitted from the print head to the leuco-type dye layer.

EXAMPLE 4

A bar code is printed in the leuco-type dye layer of the lamination formed in Example 2 using the procedures described in Example 3. The portion of WFLO series ink layer overlying the printed bar code is a clear ink permitting visibility of the bar code through the clear ink portion of the ink layer.

EXAMPLE 5

A first composite construction is prepared by coating one side of an 18 gauge clear polyester film supplied by Toray TPA under the tradename Lumirror F53 with a layer of clear Amertech C-41324-WI at a dry film weight of 0.8 pound per 3000 $ft^2$. A second composite construction is prepared by coating a 52 pound/ream paper having a thickness of 2.8 mils with a layer of a thermally active leuco-type dye. The first composite is adhered to the second composite with the dye layer in contact with the adhesive layer.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lamination, comprising:

a substrate having a first side and a second side;

a thermally responsive coating layer overlying said first side of said substrate, said thermally responsive coating layer being capable of forming an image when heat is selectively applied to said thermally responsive coating layer;

a light transmissive protective layer overlying said thermally responsive coating layer, said light transmissive protective layer having an image receiving surface and being capable of transmitting heat applied thereto to said thermally responsive coating layer; and an adhesive layer positioned between said light transmissive protective layer and said thermally responsive coating layer.

2. The lamination of claim 1 wherein said lamination further comprises another light transmissive protective layer positioned between said thermally responsive coating layer and said adhesive layer.

3. The lamination of claim 2 wherein said another light transmissive protective layer is derived from a solvent-based, water-based or radiation-curable coating material.

4. The lamination of claim 2 wherein said another light transmissive protective layer is derived from UV curable oligomers selected from one or more epoxies, urethanes, polyesters, acrylics, or a combination of two or more thereof.

5. The lamination of claim 2 wherein said another light transmissive protective layer is derived from cationically cured epoxy resins or alkyl vinyl esters.

6. The lamination of claim 1 wherein said lamination further comprises an ink or graphics layer adhered to the image receiving surface of said light transmissive protective layer.

7. The lamination of claim 6 wherein said ink or graphics layer is mono-colored or multi-colored ink layer.

8. The lamination of claim 6 wherein said ink or graphics layer is derived from a water-based, solvent-based or radiation-curable ink.

9. The lamination of claim 1 wherein said lamination further comprises a friction reducing coating layer overlying said light transmissive protective layer.

10. The lamination of claim 9 wherein said friction reducing coating layer is comprised of a silicone coating or a wax.

11. The lamination of claim 1 wherein said lamination further comprises a layer of a pressure sensitive adhesive overlying said second side of said substrate.

12. The lamination of claim 1 wherein said lamination further comprises a release liner overlying said layer of pressure sensitive adhesive.

13. The lamination of claim 1 wherein said substrate is comprised of paper, metal foil, polymer film, or a combination thereof.

14. The lamination of claim 1 wherein said substrate is comprised of textile.

15. The lamination of claim 1 wherein said substrate is a single-layered construction.

16. The lamination of claim 1 wherein said substrate is a multi-layered construction.

17. The lamination of claim 1 wherein said thermally responsive coating layer is derived from a ferric ionic inorganic salt solution.

18. The lamination of claim 1 wherein said thermally responsive coating layer is comprised of a leuco-type dye.

19. The lamination of claim 1 wherein said thermally responsive coating layer is comprised of a leuco-type dye and a color developing agent.

20. The lamination of claim 1 wherein said light transmissive protective layer is comprised of a thermoplastic polymer composition having a melting point in the range of about 85° C. to about 600° C., and a thermal conductivity in the range of about $1\times10^{-4}$ to about $10\times10^{-4}$ calories/cm-sec-° C.

21. The lamination of claim 1 wherein said light transmissive protective layer is derived from a thermoplastic polymer selected from one or more esters, urethanes, epoxies, phenoxies, acrylics, or a combination of two or more thereof.

22. The lamination of claim 1 wherein said light transmissive protective layer is comprised of polyolefin, polyvinylchloride or polystyrene.

23. The lamination of claim 1 wherein said light transmissive protective layer is comprised of a polyester film having a gauge thickness of about 14 to about 26.

24. The lamination of claim 1 wherein said adhesive layer is comprised of a moisture-curable adhesive, catalyst curable adhesive or pressure sensitive adhesive.

25. The lamination of claim 1 wherein said adhesive layer is comprised of a moisture-curable isocyanate terminated polyether urethane adhesive.

26. The lamination of claim 1 wherein said adhesive layer is comprised of a catalyzed polyester adhesive.

27. A lamination, comprising:

a substrate having a first side and a second side;

a thermally responsive coating layer overlying said first side of said substrate, said thermally responsive coating layer being capable of forming an image when heat is selectively applied to said thermally responsive coating layer;

a light transmissive protective layer overlying said thermally responsive coating layer, said light transmissive protective layer having an image receiving surface and being capable of transmitting heat applied thereto to said thermally responsive coating layer;

an adhesive layer positioned between said light transmissive protective layer and said thermally responsive coating layer;

a layer of a pressure sensitive adhesive overlying said second side of said substrate; and a release liner adhered to said layer of said pressure sensitive adhesive.

28. The lamination of claim 27 wherein said lamination further comprises a friction reducing coating layer overlying said light transmissive protective layer.

29. The lamination of claim 27 wherein said lamination further comprises an ink layer adhered to the image receiving surface of said light transmissive protective layer.

30. The lamination of claim 27 wherein said lamination further comprises another light transmissive protective layer positioned between said thermally responsive coating layer and said adhesive layer.

31. A process for forming a lamination, comprising:

forming a first composite construction by coating one side of a substrate with a thermally responsive coating layer, and then coating the thermally responsive coating layer with a light transmissive protective coating layer;

forming a second composite construction by applying a release coating layer to a backing liner, curing the release coating, and then coating the cured release coating with a layer of a pressure sensitive adhesive;

forming a third composite construction by coating one side of a light transmissive protective film with a friction reducing coating layer, said light transmissive protective film having an image receiving surface, and coating the other side of the light transmissive protective film with an adhesive layer;

forming a first intermediate construction by adhering the first composite construction to the second composite construction; and forming said lamination by adhering said first intermediate construction to said third composite construction.

32. The process of claim 31 wherein an ink or graphics layer is adhered to the image receiving surface of said light transmissive protective film.

* * * * *